United States Patent [19]

Blocker, Jr.

[11] 4,194,323

[45] Mar. 25, 1980

[54] CENTERLESS GRINDER

[75] Inventor: Edwin W. Blocker, Jr., Herndon, Va.

[73] Assignee: Combustion Engineering, Inc., Windsor, Conn.

[21] Appl. No.: 965,222

[22] Filed: Nov. 30, 1978

[51] Int. Cl.[2] ..... B24B 5/18

[52] U.S. Cl. ..... 51/103 R; 51/103 TF; 51/281 R

[58] Field of Search ..... 51/103 R, 103 TF, 103 WH, 51/281 R, 289 R

[56] References Cited

U.S. PATENT DOCUMENTS

| | | | |
|---|---|---|---|
| 1,783,034 | 11/1930 | Booth | 51/103 TF X |
| 2,110,086 | 3/1938 | Indge | 51/103 TF |
| 2,205,468 | 6/1940 | Cramer | 51/103 WH |
| 2,224,423 | 12/1940 | Binns | 51/103 TF |
| 2,438,239 | 3/1948 | Toulmin | 51/103 TF X |
| 2,579,520 | 12/1951 | Smith | 51/103 TF |
| 3,133,382 | 5/1964 | Messerschmidt | 51/103 TF |
| 4,107,881 | 8/1978 | Jessup | 51/103 TF X |

*Primary Examiner*—Gary L. Smith
*Assistant Examiner*—Robert P. Olszewski

[57] ABSTRACT

The grinding wheel of a centerless grinder comprises a cylindrical abrasive grinding surface sandwiched between two slightly frustoconical guide surfaces made of a resilient material. The regulating wheel has a surface that mates with the composite surface of the grinding wheel. This arrangement permits blanks of a brittle material fed axially of the wheel to be ground to a barrel shape without chipping.

6 Claims, 2 Drawing Figures

CENTERLESS GRINDER

BACKGROUND OF THE INVENTION

The present invention relates to a centerless grinder and in particular to a method and apparatus for grinding blanks of a brittle material into barrel shapes.

A typical nuclear reactor fuel element is formed of an elongated cylindrical jacket or cladding of a material such as zirconium or stainless steel surrounding a column of many shorter cylindrical fuel pellets stacked end to end. The pellets are predominantly oxide ceramic materials produced by the compression of powders in a cylindrical mold. The pellets are then sintered to obtain the desired density, and must subsequently be ground to the final desired shape. Fuel pellets manufactured in this manner tend to be extremely brittle and are subject to chipping during the grinding operation.

Recent technological advancements indicate that it is most desirable to have the fuel pellets formed in a barrel shape. However, difficulty has been experienced in grinding cylindrical blanks of a brittle material, such as the oxide ceramics of nuclear fuel, into barrel-shaped pellets in a continuous yet simple manner.

Smith, U.S. Pat. No. 2,579,520 describes a representative method of grinding barrel-shaped pieces. The grinding wheel and the regulating wheel in the Smith specification have surfaces that mate to form an opening in the shape of the cross section of the desired pellet. To feed the blanks into the grinder, either the grinding wheel or the work wheel is slid outward to allow the blanks to be dropped into the grinder. Such a stepwise infeed operation is too slow and cumbersome to be economical for the manufacture of nuclear fuel pellets.

The continuous through-feed centerless grinders of the prior art have also proven unsuitable for grinding barrel-shaped pellets from cylindrical blanks of brittle material. In centerless grinders of this type, blanks are continuously fed parallel to the axis of a grinding wheel through an inlet guide into the gap between the grinding wheel and the regulating wheel and are collected in an outlet guide at the other side. By misaligning the guide in the direction of the regulating wheel, a barrel-shaped pellet can be formed from the cylindrical blanks. However, experience has shown that cylindrical blanks of brittle material are subject to frequent and excessive chipping when ground in such a grinder. Therefore, this method and apparatus, although providing a continuous operation, is unacceptable for manufacturing nuclear fuel pellets.

SUMMARY OF THE INVENTION

The present invention is a method and apparatus for the centerless grinding of a cylindrical blank of brittle material to a barrel shape without chipping that permits the cylindrical blanks to be continuously and through-fed across the surface of the wheels.

The apparatus of the present invention comprises a grinding wheel having a cylindrical grinding surface joined at one edge to the smaller radius edge of a first frustoconical guide surface and at its other edge to the smaller radius edge of a second frustoconical guide surface. The radii of the smaller radius edges of the frustoconical guide surfaces are equal to the radius of the cylindrical grinding surface so that the three surfaces together form a continuous composite surface. A regulating wheel is also provided whose axis is nearly parallel to the axis of the grinding wheel and whose circumferential surface is shaped to mate with the composite surface of the grinding wheel. The regulating wheel is positioned so that the circumferential surface of the regulating wheel faces but is spaced from the circumferential surface of the grinding wheel so as to define a gap into which cylindrical blanks are fed. Preferably, the cylindrical grinding surface is made of an abrasive such as aluminum oxide, silicon carbide, or diamond, and the frustoconical guide surfaces are made of a resilient material such as cork, rubber, or wood.

DETAILED DESCRIPTION OF THE PREFERRED EMBODIMENT

Figure 1:
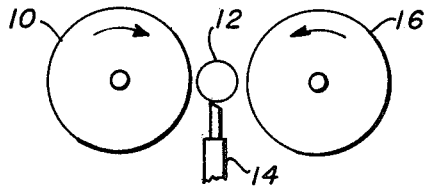
FIG. 1 is a diagrammatic vertical elevation of a typical centerless grinder known in the art.

The typical arrangement of a centerless grinder is shown diagrammatically in FIG. 1. A grinding wheel 10 has an abrasive surface, such as silicon carbide or diamond, and, as indicated in FIG. 1, the grinding wheel 10 rotates clockwise during operation. A regulating wheel 16, which has a nonabrasive surface, is spaced from the grinding wheel and is orientated so that its axis is nearly parallel to that of the grinding wheel. A work rest 14 is normally provided between the wheels so as to support a blank such as that indicated by the reference 12 in FIG. 1. The regulating wheel is rotated in the counterclockwise direction in opposition to the rotation of the grinding wheel, and a blank 12 is placed on the work rest at the edges of the wheels 10 and 16 and held in place against the work rest by a counter-rotation of the wheels. The wheels then engage the blank, grinding it and propelling it across their surfaces until it is expelled from their opposite edges.

Figure 2:
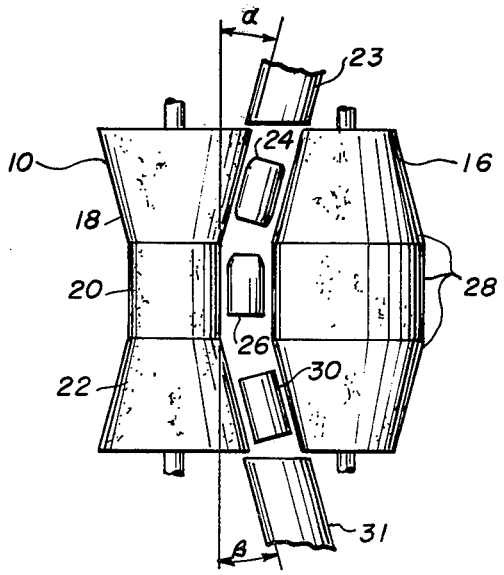
FIG. 2 is a diagrammatic plan view of a centerless grinder built according to the teachings of the present invention.

According to the present invention, the grinding wheel has a shape shown in an exaggerated fashion in FIG. 2. The grinding wheel 10 comprises three sections, a center grinding section 20 made of an abrasive material and two outer frictional surfaces 18 and 22 made of a resilient material. Preferably, the center abrasive section 20 is made of silicon carbide and the two outer frictional sections 18 and 22 are made of cork. The grinding wheel thus has a composite surface made of a cylindrical grinding section sandwiched between two frustoconical surfaces of the outer guide sections 18 and 22 being equal to the radius of the cylindrical surface of the center grinding section 20. Since the smaller radius edges of the frustoconical surfaces meet the edges of the cylindrical surface, they make up a single continuous composite surface.

The regulating wheel 16 has a composite surface 28 that mates with the composite surface of the grinding wheel and is spaced from it. As shown in FIG. 2, the circumferential surfaces of wheels 10 and 16 are according to the present invention shaped to mate with each other and positioned to face each other; that is, the mating surfaces are positioned so that corresponding parts are in registration. The axes of the wheels are nearly parallel so that a plane can be thought to be defined by the parallel axes, and blanks are fed in the gap between the surfaces in a direction parallel to the plane of the axes, i.e. the blanks are fed axially. As a practical matter, the axis of the grinding wheel is normally cocked slightly out of the plane in order that the blanks may be propelled across the surfaces of the wheels by the counter rotation of the wheels.

It is noted that the frustoconical surfaces form angles $\alpha$ and $\beta$ with the surface of the cylindrical section 20. The angle $\beta$ on the entering side is somewhat larger than the angle $\alpha$ on the exiting side. These angles are shown for the sake of clarity as being greater than they actually are. In actuality, the angle $\beta$ only measures about 2°, while the angle $\alpha$ measures 3°.

In operation, blanks are fed to the wheels along a track 31, where they are engaged by the first frustoconical guide section 22 and the corresponding part of the surface 28 of regulating wheel 16. As it is propelled along the first frustoconical guide section 22, the cylindrical blank 30 remains cylindrical until it reaches the abrasive center grinding section 20. When the blank moves into that section, its leading portion is tapered to give a shape illustrated by blank 26. The blank continues to be propelled across the surfaces of the wheels; and as it reaches the second frustoconical guide surface 18, its trailing end begins to be tapered until it achieves the total barrel shape exemplified by the finished product 24. The finished barrel-shaped pellets are then lead away from the wheel on track 23.

For the angles of $\alpha=3°$ and $\beta=2°$, a cylindrical blank that is 1.65 centimeters long and 1.38 millimeters in diameter can be tapered to a barrel having a radius of curvature of about 90 centimeters. When a brittle material such as uranium oxide used in nuclear reactors is to be ground, the grinding to this barrel shape would normally be made in several passes, each pass taking only a small amount off the radius of the pellet. This would not detract from the continuous nature of the operation, however, since a rather long run of blanks could be processed in a first pass before it would be necessary to readjust the wheelsfor a second pass.

The method and apparatus of the present invention enables barrel-shaped pellets to be produced in a continuous operation using relatively simple machinery. The specific design of the centerless grinder of the present invention as described hereinabove permits blanks to be through-fed to the grinding surface in a continuous operation without moving either the grinding wheel or the regulating wheel. Further, because the frustoconical guide surfaces of the composite grinding wheel are of a resilient material, blanks of delicate, brittle material can be ground to the desired barrel shape without the frequent and excessive chipping experienced in the prior art.

What is claimed is:

1. An apparatus for grinding to a barrel shape, comprising:

a. a grinding wheel comprising a composite circumferential surface that includes a cylindrical surface, a first frustoconical surface joined at its smaller-radius edge to one edge of the cylindrical surface, and a second frustoconical surface joined at its smaller-radius edge to the other edge of the cylindrical surface, the radii of the smaller-radius edges of the frustoconical surfaces being equal to the radius of the cylindrical surfaces, the three surfaces thereby together forming a continuous composite surface; and b. a regulating wheel comprising a circumferential surface shaped to mate with the composite surface of the grinding wheel, the axis of the regulating wheel being positioned nearly parallel to the axis of the grinding wheel, the regulating wheel being further positioned so that the circumferential surface of the regulating wheel faces but is spaced from the circumferential surface of the grinding wheel.

2. An apparatus as recited in claim 1, wherein the cylindrical surface is composed of an abrasive.

3. An apparatus as recited in claim 2, wherein the frustoconical surfaces are composed of a resilient material.

4. An apparatus as recited in claim 2 or 3, wherein the abrasive is selected from the group consisting of aluminum oxide, silicon carbide, and diamond.

5. An apparatus as recited in claim 4, wherein the resilient material is selected from the group consisting of cork, rubber, and wood.

6. A method for the centerless grinding of a blank to a barrel shape, comprising the steps of:

a. providing a grinding wheel comprising a composite circumferential surface that comprises a cylindrical surface, a first frustoconical surface joined at its smaller-radius edge to one edge of the cylindrical surface, and a second frustoconical surface joined at its smaller-radius edge to the other edge of the cylindrical surface, the radii of the smaller-radius edges of the frustoconical surfaces being equal to the radius of the cylindrical surface, the three surfaces being equal to the radius of the cylindrical surface the three surfaces thereby forming a continuous composite surface;

b. providing a regulating wheel that has a circumferential surface shaped to mate with the composite surface of the grinding wheel, the regulating wheel faces but is spaced from the circumferential surface of the grinding wheel so as to define a gap between the surfaces, the axes of the wheels being nearly parallel but skewed enough to cause a blank fed into the gap to be propelled across the surfaces of the wheels when they are rotating;

c. feeding a blank into the gap between the wheels in a plane generally parallel to the plane of the wheels' axes; and d. causing the wheels to rotate in opposite directions, thereby causing the blank to be propelled across the surfaces of the wheels and to grind it to a barrel shape.

* * * * *